US008887540B2

(12) United States Patent
Geyer

(10) Patent No.: US 8,887,540 B2
(45) Date of Patent: Nov. 18, 2014

(54) LAUNDRY DRUM FOR A LAUNDRY TREATMENT MACHINE

(75) Inventor: Johannes Geyer, Haar (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 1008 days.

(21) Appl. No.: 12/844,870

(22) Filed: Jul. 28, 2010

(65) Prior Publication Data

US 2012/0024022 A1 Feb. 2, 2012

(51) Int. Cl.

| | |
|---|---|
| ***D06F 37/06*** | (2006.01) |
| ***D06F 37/14*** | (2006.01) |
| *D06F 58/04* | (2006.01) |

(52) U.S. Cl.

CPC ..... *D06F 58/04* (2013.01); *D06F 37/14* (2013.01); *D06F 37/06* (2013.01)

USPC ..... 68/142; 68/139; 68/144

(58) Field of Classification Search

USPC ..... 68/142

See application file for complete search history.

(56) References Cited

U.S. PATENT DOCUMENTS

| | | | | |
|---|---|---|---|---|
| 5,782,111 | A * | 7/1998 | Sights et al. | 68/142 |
| 6,971,189 | B1 * | 12/2005 | Anibas | 34/602 |
| 2008/0006065 | A1 * | 1/2008 | Fumagalli | 68/235 R |
| 2009/0183531 | A1 | 7/2009 | Heubner et al. | |

FOREIGN PATENT DOCUMENTS

| | | | |
|---|---|---|---|
| DE | 4437986 | A1 | 4/1996 |
| WO | 03054275 | A1 | 7/2003 |
| WO | 2004072354 | A1 | 8/2004 |

* cited by examiner

*Primary Examiner* — Michael Barr
*Assistant Examiner* — Levon J Shahinian
(74) *Attorney, Agent, or Firm* — Jordan IP Law, LLC; Tood A. Vaughn

(57) ABSTRACT

A laundry drum on the one hand is to exhibit the advantageous features of structures of the prior art distributed in the circumferential direction, which protrude from the cylinder shape of the drum casing accommodated in the laundry drum, but at the same time however create the basics for their embodiment for advantageous influencing of the laundry movement within the laundry drum during its rotational movement. To this end structures are inventively formed from ring-shaped protrusions distributed in the circumferential direction.

6 Claims, 4 Drawing Sheets

LAUNDRY DRUM FOR A LAUNDRY TREATMENT MACHINE

BACKGROUND OF THE INVENTION

The invention relates to a laundry drum for a laundry treatment machine with a drum casing which features structures distributed in the circumferential direction which are raised from the cylinder shape of the drum casing accommodated in the laundry drum.

A laundry drum of this type is known from DE 44 37 986 A1.This document above all discloses structures in the casing metal of a laundry drum in the form of rectangular or hexagonal indented surfaces offset in relation to each other. Such structures have been predominantly used with laundry drums because on the one hand they impart a certain stability of form to the structured sheet casing which above all has the effect of reducing the tendency to acoustic vibration. On the other hand however such a structure also has a certain decorative effect. An assumed advantageous influence on the mechanical laundry treatment on the other hand cannot be verified with this type of structure.

A laundry drum known from WO 2004/072354 contains protrusions distributed likewise on the drum bottom and in the circumferential direction on the drum bottom, which are likewise to have an advantageous influence on the mechanical laundry treatment. Its actuating effect of the drum casing on the laundry elements is however restricted because the protrusions are aligned irregularly and because there is no clarity in respect of the shape of the protrusions. Furthermore, its drum casing may be difficult to manufacture in terms of retaining a consistent quality because the irregular shape, arrangement and alignment of the protrusions may result in the drum casing metal buckling as a result of unforeseeable material performances and stretches when stamping the protrusions.

BRIEF SUMMARY OF THE INVENTION

The underlying object of the invention is to find a casing sheet structure for a laundry drum as described at the outset which on the one hand has the advantageous characteristics of structures of the prior art but basically also creates the fundamentals for embodying them for advantageous influencing of the mechanical laundry treatment during the rotational movement of the drum. In particular structures are required which in addition to the rigidity-forming effect, exercise a certain frictional effect on the laundry, which with the rotation of the washing drum makes able to carry the items of laundry with it over the largest possible angle of rotation.

The manner in which this object is inventively achieved is by each structure consisting of a linear protrusion, which is closed in a ring-shaped fashion. Such protrusions—as will be subsequently explained below—can be embodied in many respects so that during the rotation of the drum they have an advantageous influence on the frictional effect in relation to the washing. Since they also do stabilize the drum casing to the extent that the material used for the metal of the drum is able to be reduced to a minimum so that no tendencies to acoustic vibration are to be feared, and that the surface properties of a casing surface formed in such a way are almost ideal for laundry treatment, an inventively embodied laundry drum will represent an optimum for use in laundry treatment. Such protrusions can be arranged in more or less regular distribution over the drum casing.

The stiffening of the drum casing resulting from the provision of the inventive structures has the additional advantageous effect that the tendency of the drum casing to generate acoustic resonance and the droning resulting from this is reduced when it is subjected to the loads during ordinary operation by the laundry tumbling about within the drum or especially by noises caused by the drive motor from the inside of a laundry treatment machine to which the laundry drum belongs.

Advantageously the ring-shaped closed, linear protrusions can be arranged in rows which are oriented in the circumferential direction. Plus the protrusions can follow straight rows which extend that least partially in parallel or not in parallel to each other and/or to the circumferential direction of the drum. The rows in the circumferential direction can be continuous or interrupted. They can be at either equal or unequal distances from each other and can be equal in width or at least partly unequal in width or of different widths. They can follow wave lines, e.g. sine waves, zigzag lines or helical lines and, seen in relation to the axial direction of the drum, be equal in phase or offset in relation to each other. The protrusions of one row can also be the same size and those of another row can have a different diameter. The diameters of the protrusions can also differ from each other within one row. The ring-shaped closed linear protrusions can be circular or elliptical. The drum casing especially does not have any holes for the passage of fluid. Thus the use of the invention in a laundry treatment machine in the form of the tumble drier can be inferred.

BRIEF DESCRIPTION OF THE DRAWINGS

The invention will be explained in greater detail below with reference to exemplary embodiments shown in the drawing. The individual figures show.

DETAILED DESCRIPTION OF EXEMPLARY EMBODIMENTS OF THE PRESENT INVENTION

Figure 1:
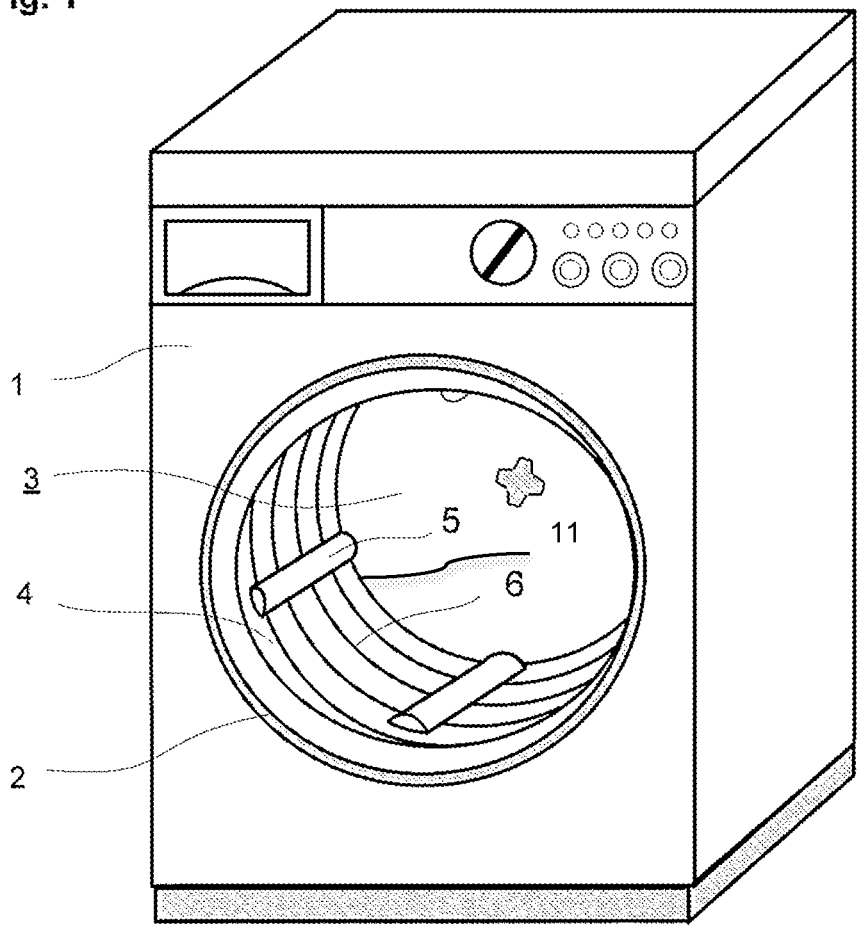
FIG. 1 a perspective view of the front side of a laundry drying machine with an unrestricted view into the laundry drum, the casing metal of which is provided on the inner side with protrusions arranged in rows, FIG. 2 a cross section through a metal casing in parallel to the direction of the axis of the laundry drum with ring-shaped protrusions, FIG. 3 a cross section as in FIG. 2 with additional lens-shaped protrusions arranged concentrically to the ring-shaped protrusions, FIG. 4 the view from outside onto a metal casing with equal-phase linearly arranged rows of protrusions comprising rings and lenses, and FIG. 5 the view from outside onto a metal casing with unequal-phase linearly arranged rows of protrusions comprising rings and lenses.

FIG. 1 shows a laundry drying machine as a laundry treatment machine, of which the loading opening 2 fitted to the front side 1 with the door removed gives a view into the inside of the laundry drum 3. It has a cylindrical drum casing 4, on the inside of which a number of laundry agitators 5 are evenly distributed. In addition the drum casing 4 has rows of ring-shaped arched protrusions to its inside which will be explained in greater detail with reference to the subsequent figures. Since laundry agitators 5 in dryers are best kept flat, these protrusions on the one hand make sure that an especially washing-friendly surface design is obtained, which still creates an increased friction effect in relation to the washing, whereby, despite the flat agitators, the washing is lifted very high up during the drum rotation, from where it can fall freely through the drying air stream in the laundry drum. In addition the protrusions help to embody the drum casing mechanically vibration-rigid, which means that there is no danger of the acoustic problems which might otherwise arise. On the other hand, a significant increase in rigidity allows savings to be made in material through thinner wall thicknesses of the drum casing 4.

Figure 2:
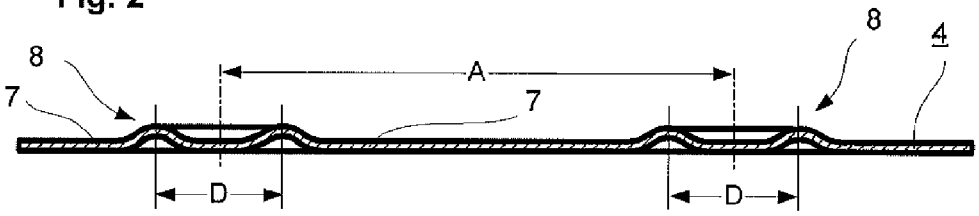
Figure 3:
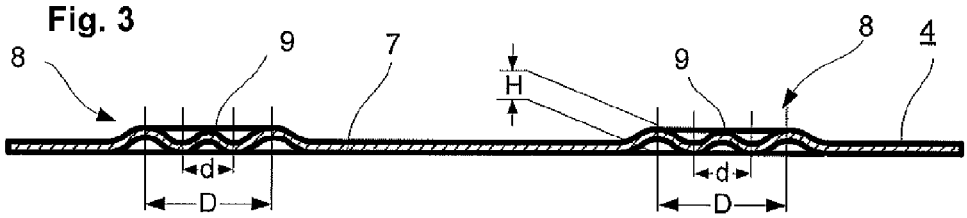

For example rows 6 of ring shaped protrusions 8 according to FIG. 1 seen in the cross section of the metal of such a drum casing 4, can assume a form depicted in FIG. 2 or FIG. 3. In such cases the protrusion 8 curves gradually inwards away from the cylinder shape of the area 7 of the drum casing 4, forms a ring-shaped ridge line with a diameter D and likewise curves slightly back into the cylinder shape of the area 7. The remaining areas 7 in the cylinder shape are closed for a laundry drying machine which does not need any exchange of fluid for the treatment process, i.e. they have no flood holes.

Figure 5:
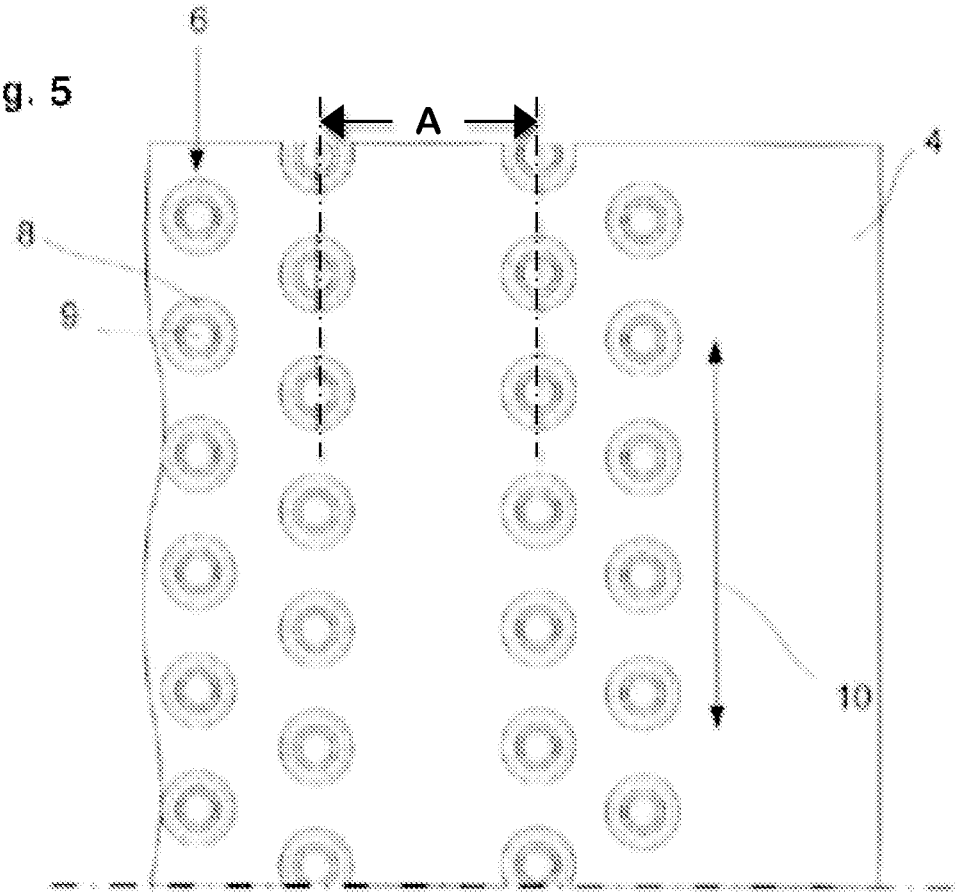

In such cases the spacings A of the lines of symmetry of the protrusions in FIGS. 2 and 3 are the same size in relation to each other. As illustrated in FIG. 5, these distances can however also be of unequal sizes. This can play a part in treatment processes such as those in which the laundry is unevenly distributed within the drum during its rotation.

FIG. 3 shows a variant of FIG. 2 in which, within each ring-shaped protrusion 8 a concentric lens-shaped protrusion 9 with a diameter d—referred to for short below as a lens 9—is embossed into the cylinder surface of the laundry drum. This once again increases the rigidity of the drum casing and increases the friction effect in relation to the laundry.

Figure 4:
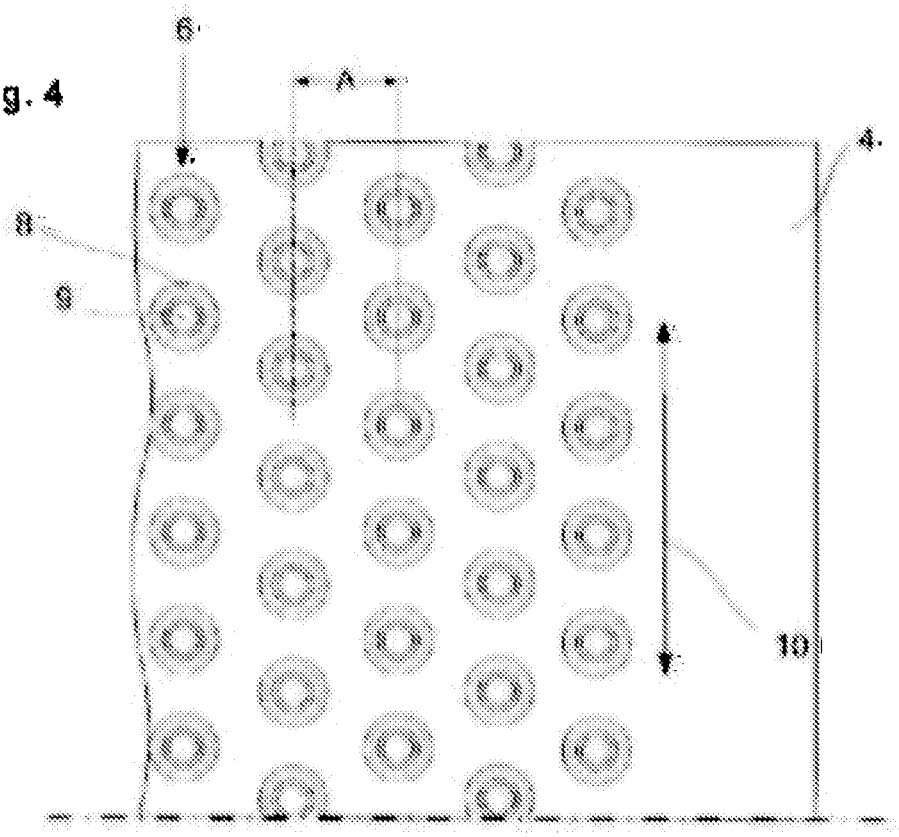

In accordance with FIG. 4 the drum casing 4 has on its inner side rows 6 of ring-shaped protrusions 8 with lenses 9 with run all around the drum in the circumferential direction in a closed circle. By contrast the rows 6 in the circumferential direction 10 can also have a restricted length, by leaving out a protrusion at regular intervals (e.g. every fifth protrusion 8) or at irregular intervals. In FIG. 4 the rows are shown with even spacings A.

By contrast however adjacent rows can also be arranged with unequal spacings. It is conceivable for example for the rows 6 in the vicinity of the drum floor of a laundry drum to have narrower spacings than in the middle of the drum. The protrusions also do not have to be completely circular as shown in FIG. 4; their basic shape can also be that of an ellipse.

The rows 6 do not also absolutely have to lie in parallel with the side or outer line 11 of the drum casing 4. There can be reasons for the rows 6 to lie in a helical form around the circumferential direction 10. There can also be reasons for the rows 6 to be arranged unevenly. For example alignments of the rows 6 in a wave shape or in zig-zag lines are possible.

In the same way the values of the height H of the ring-shaped protrusions and of the lenses 8 can also be designed as variable. They can also be of unequal heights in direct comparison. For example it can be worthwhile for the value of the height of the lens 9 to be greater in relation to the value H of the ring-shaped protrusion 8.

But also the values of the height H of the ring-shaped protrusions 8 and/or 9 can differ between protrusions. For example it can be sensible with an alternating rotating operation of the laundry drum 3 for the consecutive protrusions 8 and/or 9 to form a row with increasing height in relation to the drum surface of the laundry drum 3. This rise can typically suddenly revert to the initial value after a certain number of protrusions. This produces a discontinuity which in one drum direction leads to a soft treatment of the laundry, but in the other direction of rotation to a more intensive treatment if this is required. Otherwise however the value of the height H can alternately constantly rise and fall, independent of control of the direction of rotation of the laundry drum 3.

What is claimed is:

1. A laundry drum, comprising:

a drum casing;

a plurality of first raised protrusions having a closed, circular shape provided on the drum casing; and a plurality of second raised protrusions having a closed, circular shape provided on the drum casing and arranged concentrically with respect to the plurality of first raised protrusions.

2. The laundry drum of claim 1, wherein:

the plurality of first raised protrusions have a first diameter; and the plurality of second raised protrusions have a second diameter which is different than the first diameter.

3. The laundry drum of claim 2, wherein the first diameter is greater than the second diameter.

4. The laundry drum of claim 1, wherein:

the plurality of first raised protrusions have a first height; and the plurality of second raised protrusions have a second height.

5. The laundry drum of claim 4, wherein the first height is different than the second height.

6. The laundry drum of claim 4, wherein the first height is equal to the second height.

* * * * *